US010923811B2

(12) United States Patent
Gonzalez et al.

(10) Patent No.: US 10,923,811 B2
(45) Date of Patent: Feb. 16, 2021

(54) INTEGRATED FILTERING FOR BAND REJECTION IN AN ANTENNA ELEMENT

(71) Applicant: Huawei Technologies Co., Ltd., Shenzhen (CN)

(72) Inventors: Ignacio Gonzalez, Munich (DE); Bruno Biscontini, Munich (DE); Titos Kokkinos, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 253 days.

(21) Appl. No.: 16/390,929

(22) Filed: Apr. 22, 2019

(65) Prior Publication Data

US 2019/0319352 A1 Oct. 17, 2019

Related U.S. Application Data

(63) Continuation of application No. PCT/EP2016/075158, filed on Oct. 20, 2016.

(51) Int. Cl.
*H01Q 1/52* (2006.01)
*H01Q 5/378* (2015.01)
(Continued)

(52) U.S. Cl.
CPC ..... *H01Q 1/523* (2013.01); *H01Q 1/246* (2013.01); *H01Q 1/38* (2013.01); *H01Q 5/378* (2015.01); *H01Q 21/30* (2013.01)

(58) Field of Classification Search
CPC ..... H01Q 1/523; H01Q 5/378; H01Q 1/246; H01Q 1/38; H01Q 21/30; H01Q 1/521
See application file for complete search history.

(56) References Cited

U.S. PATENT DOCUMENTS 7,283,101 B2 10/2007 Bisiules et al.
9,722,323 B2 * 8/2017 Yona ..... H01Q 21/24
(Continued)

FOREIGN PATENT DOCUMENTS

CN 201515013 U 6/2010
CN 202076403 U 12/2011
(Continued)

OTHER PUBLICATIONS

Park,"An Equivalent Circuit and Modeling Method for Defected Ground Structure and Its Application to the Design of Microwave Circuits," Microwave Journal 46(11), pp. 1-7, 2003 Horizon House Publications, Inc. (Nov. 2003).
(Continued)

*Primary Examiner* — Daniel D Chang
(74) *Attorney, Agent, or Firm* — Leydig, Voit & Mayer, Ltd.

(57) ABSTRACT

An antenna element is provided. The antenna element comprises: a support structure; a radiating structure arranged on or within the support structure, said radiating structure comprising: a radiating element having a resonant frequency inside an operating frequency band of the antenna element; and a filter connected to the radiating element and configured to filter out harmonics of the operating frequency band. An antenna system is also provided, which comprises a first antenna element according to the first aspect configured to radiate in a first operating frequency band, and a second antenna element configured to radiate in a second operating frequency band, wherein the second operating frequency band overlaps with harmonics of the first operating frequency band.

19 Claims, 14 Drawing Sheets

(51) Int. Cl.

| | |
|---|---|
| ***H01Q 1/24*** | (2006.01) |
| ***H01Q 1/38*** | (2006.01) |
| ***H01Q 21/30*** | (2006.01) |

(56) References Cited

U.S. PATENT DOCUMENTS

| | | | | |
|---|---|---|---|---|
| 2004/0145532 | A1 | 7/2004 | Chen et al. | |
| 2011/0260941 | A1 | 10/2011 | Jones et al. | |
| 2015/0325928 | A1 | 11/2015 | Chao | |
| 2020/0127389 | A1* | 4/2020 | Li | H01Q 1/246 |

FOREIGN PATENT DOCUMENTS

| | | | | |
|---|---|---|---|---|
| CN | 104409833 | A | 3/2015 | |
| CN | 105703062 | A | 6/2016 | |
| EP | 2665125 | A1 | 11/2013 | |
| EP | 3168927 | A1 | 5/2017 | |
| EP | 3232504 | A1 | 10/2017 | |
| GB | 2532727 | A | 6/2016 | |
| WO | 2013144965 | A1 | 10/2013 | |
| WO | WO-2013144965 | A1 * | 10/2013 | H01Q 9/285 |
| WO | 2014059946 | A1 | 4/2014 | |

OTHER PUBLICATIONS

Weng et al.,"An Overview on Defected Ground Structure," Progress in Electromagnetic Research B, vol. 7, pp. 173-189, pp. 1-17, National Key Laboratory of Antenna and Microwave Technology Xidian University, No. 2, South Taibai Road, Xi'an, Shaanxi, P. R. China (2008).

CN/201680090078.4, Notice of Allowance/Search Report, dated Dec. 4, 2020.

Feng et al.,"Research and Development of Miniature Base Station Antenna," www.ttm.com.cn, total 3 pages (Dec. 31, 2012). With English Abstract.

Chu et al.,"Principle of Multimode Broadband Antennas with Resonator-Loaded Dipole," The 2015 International Norkshop on Antenna Technology, 978-1-4799-7717-8, pp. 45-47, Institute of Electrical and Electronics Engineers, New York, New York (Dec. 28, 2015).

* cited by examiner bottom view top view bottom view top view bottom view top view

INTEGRATED FILTERING FOR BAND REJECTION IN AN ANTENNA ELEMENT

CROSS-REFERENCE TO RELATED APPLICATIONS

This application is a continuation of International Application No. PCT/EP2016/075158, filed on Oct. 20, 2016, the disclosure of which is hereby incorporated by reference in its entirety.

TECHNICAL FIELD

Embodiments of the present disclosure are directed to an antenna element preferably for a base station antenna and an antenna system comprising a first antenna element and a second antenna element.

BACKGROUND

With the increase of massive MIMO penetration in system deployment, a new type of antenna arrays has recently been developed. This new type of array is a combination of passive and active antennas, which requires new techniques to face new challenges. For those architectures, the coexistence of HB and CB arrays is a key technical point. As it is well known, this becomes even more challenging when trying to reduce the overall geometrical antenna dimensions, thereby arriving at a compact design and keeping radio frequency (RF) key performance indicators (KPIs). Among many other technical design strategies, one of the key points is the design of the radiating elements for the HB and the CB arrays. Ideally, they should be electrically invisible to each other. From this perspective, the physical dimensions of the radiating elements are one of the dominating factors as well as the isolation between the antenna elements.

In this context, Table 1 shows standard operating frequency bands in base station antenna systems.

TABLE 1

| Operating Band | Frequency Band | Relative Bandwidth (*) |
|---|---|---|
| LB | 690-960 MHz | 32.7% |
| MB | 1427-2400 MHz | 50.8% |
| HB | 1710-2690 MHz | 44.5% |
| CB | 3300-3800 MHz | 15% |

In Table 1 the relative bandwidth is defined as: relative bandwidth=2*(fmax−fmin)/(fmax+fmin).

Furthermore, as can be seen in FIG. 1 the HB band is shown as having an operating frequency band from around 1.7 GHz to 2.7 GHz. However, it is generally known that an element tuned for one frequency range, for example, the HB band, will also be tuned for its harmonics. A harmonic of a frequency is a signal with a frequency being a positive multiple of the frequency, wherein the frequency is called a fundamental frequency. Therefore, for example, the first harmonic of the operating frequency band (for example the HB band, which resembles a fundamental frequency range) in FIG. 1 is in the frequency range between 3.3 GHz and 5.4 GHz. Further, as shown in FIG. 1 the first harmonic of the operating frequency band overlaps with the C band, which is the frequency band from 3.3 GHz to 3.8 GHz.

Therefore, a problem exists in that that a first antenna element configured to radiate in the HB operating frequency band is excited by a second antenna element radiating in the CB operating frequency band, since the C-band overlaps with the first harmonic of the HB-operating frequency band. Therefore, even if the first antenna element is currently inactive and does not radiate at all, the first antenna element is excited by the radiation of the second antenna element currently radiating in the C-band as the operating frequency band. Accordingly, a lot of energy radiated by the second antenna element couples to the first antenna element. This energy from the second antenna element is then fed back into the corresponding feeding structure of the first antenna element.

Therefore, these signals fed back into the feeding structure of the first antenna element have to be filtered out.

Conventionally, this filtering of these signals fed back in the feeding structure of the antenna element configured radiating in the HB operating frequency band was done as shown in FIG. 2 in the HB signal path. There, one can see that the filtering is done in the feeding network either in a phase shifter or in power dividers, which comprise corresponding filters for filtering out harmonics of the HB operating frequency band. However, this concept cannot reduce the energy coupled and reradiated in the CB frequency band (i.e. the harmonics of the HB operating frequency band) by the antenna element configured to radiate in the HB operating frequency band, but can only reduce the energy coupled to the feeding network.

SUMMARY

Therefore, a problem to be solved by the present disclosure is to provide an improved antenna element having a maximized isolation between frequency bands, wherein the energy reradiated by the antenna element in the frequency range corresponding to the harmonics of the operating frequency band of the antenna element is minimized and the energy fed back into the feeding network of the antenna element is also minimized.

This problem is solved by the subject matter of the independent claims. Advantageous implementation forms are provided in the dependent claims.

In a first aspect an antenna element preferably for a base station antenna is provided, wherein the antenna element comprises: a support structure; a radiating structure arranged on or within the support structure, said radiating structure comprising: a radiating element having a resonant frequency inside an operating frequency band of the antenna element; and a filter connected to the radiating element and configured to filter out harmonics of the operating frequency band.

Since the filter is configured to filter out harmonics of the operating frequency band of the antenna element, it is possible that, for example, for an antenna element operating in the HB operating frequency band, the antenna element itself (and not the subsequent feeding structure feeding the antenna element) filters out harmonics of the HB operating frequency band within the Field domain of the antenna element itself. For example, if the antenna element according to the first aspect is a first antenna element configured to operate in the HB operating frequency band, but is currently inactive, and the first antenna element is exposed to radiation of a second antenna element currently radiating in the CB operating frequency band, then, due to the provision of the filter the energy corresponding to the CB band by which the first antenna element is exited is filtered out, so that the signals fed back into the feeding structure of the first antenna element are greatly attenuated. Therefore, the HB frequency band of the first antenna element is detuned from the CB frequency band. Further, the energy reradiated by the first antenna element in the CB frequency band is therefore also minimized and the isolation between the CB and HB frequency bands is improved. In addition, unwanted surface waves and spurious and leakage transmission is avoided and at the same time the radiation pattern of the coexisting second antenna element is improved in the filtered frequencies filtered by the first antenna element. Further, the gain of the second antenna element at the filtered frequencies is improved. Further, the filter can also be easily integrated in a PCB or MID support structure.

In a first implementation form of the first aspect the antenna element further comprises a feeding structure configured to feed the radiating element, wherein the filter is arranged within the radiating structure such that the harmonics of the operating frequency band generated in the radiating element are filtered out, isolating them from the feeding structure.

Therefore, due to the feeding structure, which can be galvanically or capacitively coupled to the radiating element, it is possible that the antenna element emits radiation within the operating frequency band, which can be, for example, the HB frequency band. Further, due to the arrangement of the filter, at the same time, signals corresponding to the harmonics are hindered to enter the feeding structure.

In a second implementation form of the first aspect the filter comprises an electrically conductive pattern comprising at least one transmission line arranged on or in the support structure, in particular a stub.

Due to the provision of a transmission line, a very flat and compact filter can be provided in a sheet-like shape, so that the filter can be easily integrated within any support structure without requiring much space within the antenna element. Further, due to the provision of transmission line, a modification of the filter for filtering out specific frequencies can be easily adapted, so that by modifying the dimensions of the transmission lines a suitable filter filtering out desired frequencies can be provided.

In a third implementation form of the first aspect the dimensions of that transmission line are configured for filtering out at least one harmonic of the operating frequency band.

Due to a variation of a length or a width of the transmission line the filter can be adapted, so that the filter filters out a certain harmonic(s) of the operating frequency band, so that in a very easy way the filter can be optimized and adapted for filtering out desired frequencies, for example the harmonics of the operating frequency band.

In a fourth implementation form of the first aspect the support structure comprises in a stacking direction of the support structure a conductive layer underneath or above the transmission line and wherein the conductive layer comprises at least one non-conductive interruption, in particular a slot, arranged so that in the stacking direction of the support structure the non-conductive interruption and the transmission line overlap.

In this context, the overlapping in the stacking direction of the support structure of the non-conductive interruption and the transmission line means that when looking in the stacking direction the non-conductive interruption and the transmission line intersect each other. Due to the arrangement of the conductive layer, for a given operating frequency the dimensions of the radiating element can be reduced. It can be said that the conductive layer is an extension of the radiating element on another side of the support structure, so that the radiating element can be designed smaller, thereby generating space for the provision of the filter. Furthermore, due to the overlapping of the non-conductive interruption and the transmission line the filter can resonate at a certain frequency, which is to be filtered out.

In a fifth implementation form of the first aspect, the non-conductive interruption together with said transmission line are configured to filter out at least one harmonic of the operating frequency band.

Therefore, the dimensions, for example, the lengths of the transmission line and the non-conductive interruption can be chosen, so that a specific harmonic of the operating frequency band can be filtered out. Therefore, a very exact way of tuning the filter is provided, wherein said filter can be adjusted for filtering out the corresponding harmonics of the operating frequency band by adapting the dimensions of the non-conductive interruption and the transmission line.

In a sixth implementation form of the first aspect the radiating element is a dipole comprising two dipole arms, the filter comprises two filtering units and the conductive layer comprises two parasitic arms.

Therefore, an antenna element is provided, which can easily be manufactured by simply providing a dipole comprising two dipole arms, a filter comprising two filtering units and a conductive layer comprising two parasitic arms. Furthermore, due to the provision of a dipole and the corresponding two filtering units and two parasitic arms a very compact antenna element can be provided.

In a seventh implementation form of the first aspect in the stacking direction each dipole arm of the two dipole arms overlaps with a corresponding parasitic arm of the two parasitic arms.

This further contributes for reducing the overall dimensions of the dipole arms, since the parasitic arm can be regarded as an extension of the corresponding dipole arm.

In an eighth implementation form of the first aspect, each dipole arm is galvanically connected to a corresponding filtering unit of the two filtering units.

This resembles a very easy and compact way for providing the filtering unit together with the corresponding dipole arm. Furthermore, due to the galvanic connection between the filtering unit and the dipole arm, an optimized filtering performance of the filtering unit can be achieved.

In a ninth implementation form of the first aspect, the two parasitic arms are floating and the two dipole arms are grounded.

This contributes for that the parasitic arms act effectively as an extension of the dipole arms, which decreases the total length of the dipole arms for a given operating frequency.

Furthermore, in a tenth implementation form of the first aspect, the antenna element further comprises at least one electrically closed ring connected to the supporting structure, wherein the ring surrounds the radiating structure and is galvanically isolated from the radiating structure.

Therefore, a ring is provided which can act as an electrical mirror for the radiating structure, so that the dimensions of the radiating element can be decreased. Further, the radiating element can then resonate at a higher frequency with respect to the center of the operating frequency band as without the ring.

In a eleventh implementation form of the first aspect the support structure comprises a conductive layer, and the filter is formed by the conductive layer and the radiating element, and the radiating element is in a stacking direction of the support structure underneath or above the conductive layer and the conductive layer is arranged so that the conductive layer and the radiating element overlap in the stacking direction of the support structure.

This refers to an arrangement in which not a separate radiating element is connected to a separate filter, but the filter is formed by the radiating element and the conductive layer, so that a capacitive filtering is provided, wherein the capacitor is composed of the conductive layer and the radiating element as the delimiting walls of the capacitor. Therefore, no non-conductive interruptions or transmission lines as in the preceding implementation forms are needed for arriving at a filter, which is configured to filter out harmonics of the operating frequency band.

In a twelfth implementation form of the first aspect the conductive filter comprises two parasitic arms, the radiating element is a dipole comprising two dipole arms and the filter comprises two filter units, wherein each filtering unit of the two filtering units is formed by one parasitic arm of the two parasitic arms and one dipole arm of the two dipole arms.

This allows a very compact design of the radiating element together with the filter, since the dipole servers for emitting radiation and at the same time servers as a delimiting wall of the capacitor for the capacitive filtering.

In a thirteenth implementation form of the first aspect, each dipole arm of the two dipole arms and each parasitic arm of the two parasitic arms is grounded.

This further contributes for arriving at an antenna element with a capacitive filtering of harmonics of the operating frequency band and further contributes for optimizing the capacitive filtering operation.

In a fourteenth implementation form of the first aspect the support structure is a printed circuit board, PCB, or a molded interconnect device, MID.

Thereby, a cost effective way for manufacturing the support structure is provided.

In a fifteenth implementation form of the first aspect, the operating frequency band is between 1.7 GHz and 2.7 GHz.

This resembles a typical example of an operating frequency band for which the harmonics are to be filtered out.

In a second aspect an antenna system is provided comprising a first antenna element according to any of the first aspect or the implementation forms of the first aspect, which is configured to radiate in a first operating frequency band, and a second antenna element configured to radiate in a second operating frequency band, wherein the second operating frequency band overlaps with harmonics of the first operating frequency band.

The second aspect refers to a system arrangement in which the second operating frequency band of the second antenna element can be, for example, the CB operating frequency band, which excites the first antenna element having for example a HB operating frequency in band. However, due to the provision of the filter, which is configured to filter out the harmonics of the first operating frequency band, signals corresponding to the CB-band are greatly attenuated in the feeding structure of the first antenna element. Therefore, it is possible to provide a very compact system in which the first antenna element is provided, for example, next to the second antenna element, so that it is no problem to provide the first antenna element next to the second antenna element, thereby arriving at a very compact antenna system, which can be provided within a base station.

DETAILED DESCRIPTION

Figure 1:
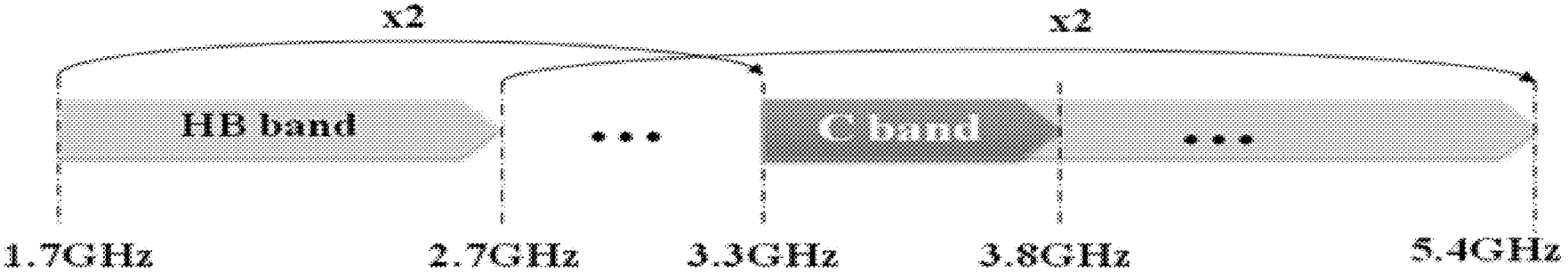
FIG. 1 illustrates the HB-band and the C-band as operating frequency bands together with the first harmonic of the HB operating frequency band.
Figure 2:
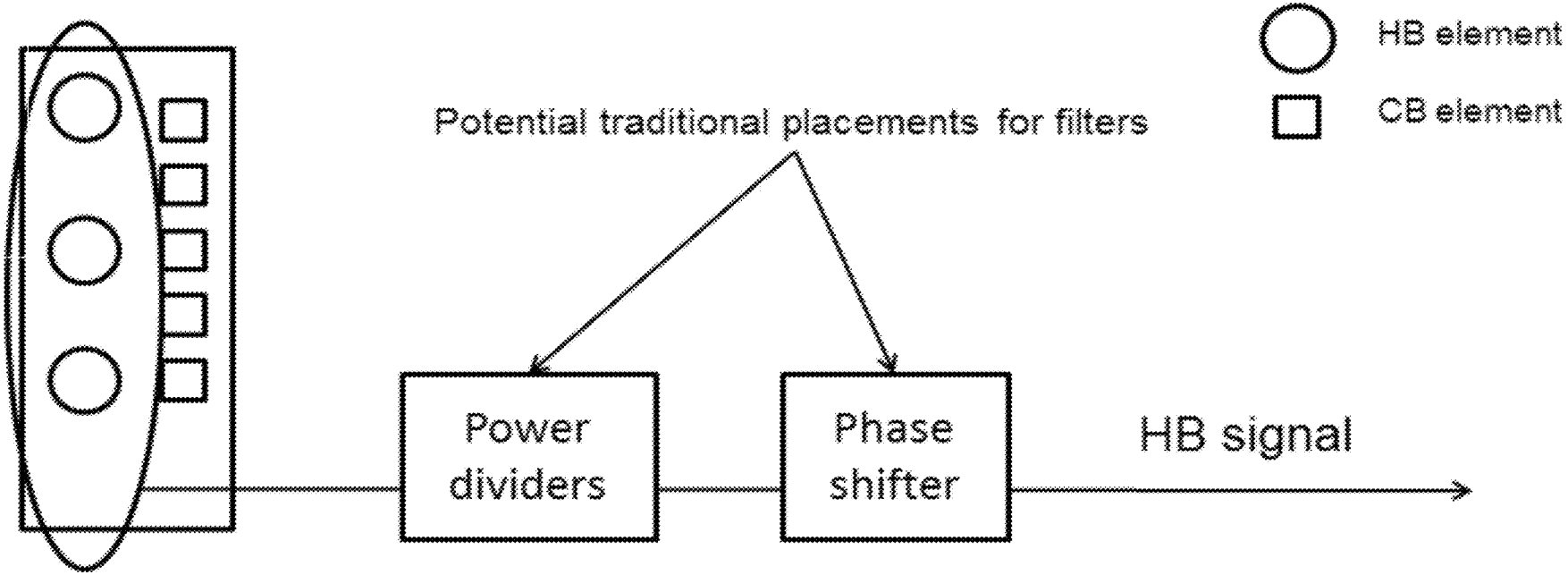
FIG. 2 illustrates a conventional filtering arrangement.
Figure 3:
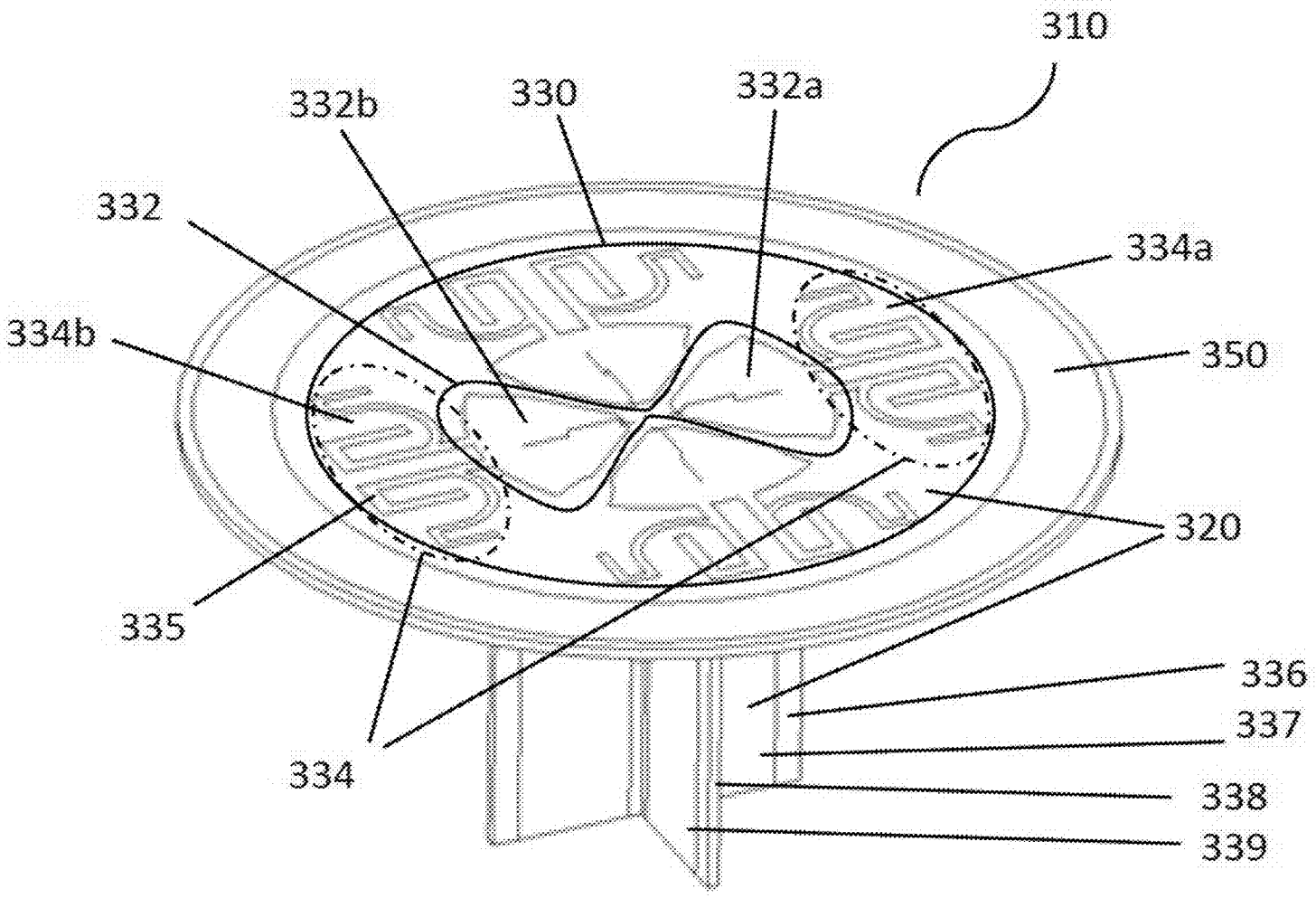
FIG. 3 shows a perspective view of an antenna element according to an embodiment of the present disclosure.

FIG. 3 shows an embodiment of an antenna element 310, preferably for a base station, of the present disclosure in a perspective view. The antenna element 310 comprises a support structure 320 and a radiating structure 330 arranged on the support structure 320, wherein the radiating structure 330 comprises a radiating element 332 having a resonant frequency inside an operating frequency band of the antenna element 310 and a filter 334 connected to the radiating element 332 and configured to filter out at least a harmonic of the operating frequency band.

Optionally, as shown in FIG. 3, the radiating element 332 is a dipole comprising two dipole arms 332*a*, 332*b*, which are provided opposite to each other on a top surface of a substrate of the support structure 320. Further, the filter 334 comprises in the embodiment of FIG. 3 two filtering units 334*a*, 334*b*, wherein one filtering unit 334*a* is connected to the corresponding dipole arm 332*a* galvanically and the other filtering unit 334*b* is also galvanically connected to the corresponding dipole arm 332*b*. The filtering units 334*a* and 334*b* comprise in FIG. 3 an electrically conductive pattern comprising transmission lines 335, which are arranged on the top surface of the support structure in a same layer as the dipole.

The dipole 332 comprising the two dipole arms 332*a*, 332*b* serves for providing an electromagnetic field of a first polarization. Furthermore, in the embodiment of FIG. 3 a second radiating element being a further dipole providing an electromagnetic field of a second polarization being perpendicular to the first polarization is provided on the top surface of the support structure 320, wherein a main extension direction, being a direction of a largest extension, of the dipole 332 is perpendicular to a main extension direction of the further dipole. Furthermore, two further filtering units are galvanically connected to the corresponding dipole arms of the further dipole, wherein the dimensions of the further two filtering units can be the same as the dimensions of the filtering units 334*a*, 334*b*.

Optionally, an electrically closed and preferably floating ring 350 can be provided, which is connected to the top surface of the support structure and the ring 350 surrounds the radiating structure 330 and is galvanically isolated from the radiating structure 330 or any other signal feed. Optionally, the ring 350 is not necessarily continuous, but can be provided with gaps which are chosen such that for the operating frequency band of the antenna element 310 "looks" electrically closed (conductive). Further, the ring 350 is not necessary provided on the top surface of the support structure, but can also be provided within the support structure. Furthermore, as in the embodiment of FIG. 3, a pair of dipole feet 336, 338 can be provided as part of the support structure 320, wherein each dipole foot can be formed by a PCBs. These PCBs can be stacked together, thereby forming the dipole feet. Each dipole foot 336, 338 can include a feeding structure, for example, microstrip lines (not shown in FIG. 3), which capacitively couple to the respective dipole. Further, on the side opposing the side on which the feeding structure are provided the surface of the same dipole foot 336, 338 can be metallized, thereby forming a balun structure 337, 339. The dipole feet 336, 338 serve for supporting the radiating structure and for galvanically or capacitively coupling the dipoles to the corresponding feeding structure. Further, the dipole arms 332*a*, 332*b* are grounded by a galvanic connection to the balun structure 337, 339 of the dipole feet 336, 338, wherein an end of the dipole feet 336, 338 penetrates through the substrate of the support structure 320 for galvanically connecting the dipole arms 332*a*, 332*b* with the dipole feet 336, 338, thereby grounding the dipole 332. However, not only a galvanic coupling between the dipole feet 336, 338 and the dipole is possible, but instead also a capacitive coupling could be used. Further, the support structure 320 can comprise in a stacking direction of the support structure 320*a* conductive layer (not shown in FIG. 3) underneath the transmission line 335 on a bottom surface of the support structure, wherein the conductive layer comprises at least one non-conductive interruption, in particular a slot, arranged so that in the stacking direction of the support structure 320 the non-conductive interruption and the transmission line 335 overlap. The conductive layer is floating.

Furthermore the dipole 332 can in this embodiment be configured to radiate within the HB operating frequency band, wherein the corresponding filter 334 is configured to filter out the harmonics of the HB operating frequency band, which should also be understood as operating frequency band of the antenna element of the embodiment of FIG. 3.

Therefore, it is possible that no signals corresponding to the CB frequency band by which the dipoles of the antenna element are excited by a further antenna element radiating in its CB operating frequency band are fed back into the feeding structure of the antenna element.

Of course the example of HB band and CB band is only one possible example for an application of embodiments of the present disclosure. The embodiments shown herein could also be modified to have their operating frequency band in other bands. Accordingly also the filter would be modified to filter out harmonic(s) of said other frequency bands.

Further, it should be noted that the dipoles of the embodiment of FIG. 3 are just an example and any other radiating element of any other dimensions can be used. Further, the dimensions and arrangement of the filter within the antenna element and the parasitic arms are just examples. Further, in FIG. 3 the same filter units are provided. However, also this is just an example and different filter units can be provided for the dipole arms. Further, the shape and dimensions of the transmission lines of the filtering units and the non-conductive interruptions can be freely chosen according to needs and FIG. 3 just provides an example. Further, the conductive layer is also only optional.

Figure 4:
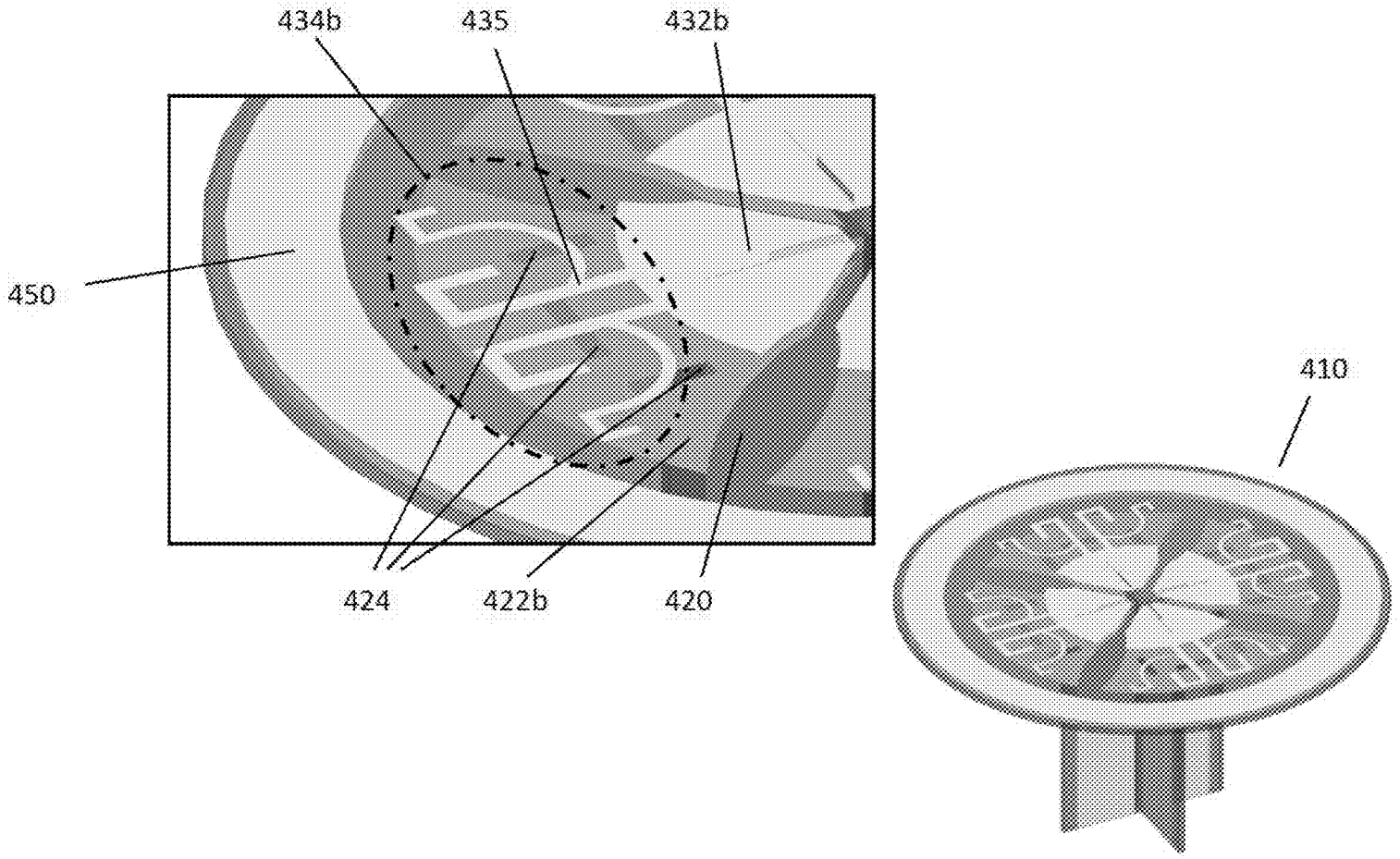
FIG. 4 shows a perspective view of an antenna element according to a further embodiment of the present disclosure.

FIG. 4 shows a further embodiment of an antenna element in a perspective view according to the present disclosure. There, the lower right figure in FIG. 4 shows an overall perspective view of the antenna element 410, and the larger left side view shows an enlarged view of a corresponding indicated area of the antenna element 410. In the enlarged view, a dipole arm 432*b* is shown, wherein the dipole arm 432*b* is provided on a top surface of the support structure 420. Furthermore, transmission lines 435 in the form of stubs are shown in a certain pattern, wherein this pattern of transmission lines 435 constitutes the filtering unit 434*b* being galvanically connected to the dipole arm 432*b* and also provided on a top surface of the support structure 420. Further, just for visualization purposes the substrate of the support structure 420 is illustrated transparent in FIG. 4. Therefore, in the perspective view of FIG. 4 one can see a parasitic arm 422*b* of a conductive layer provided on a bottom surface of the substrate of the support structure 420. In the stacking direction of the support structure 420 the parasitic arm 422*b* can overlap as in FIG. 3 with the corresponding dipole arm 432*b*. Further, the parasitic arm 422*b* is provided with non-conductive interruptions 424 being in the embodiment of FIG. 4 slots, wherein in the stacking direction of the support structure 420 the transmission lines 435 and the slots 424 intersect each other, i.e. overlap. Therefore, the parasitic arm 422*b* with the non-conductive interruptions 424 resemble a defected ground structure (DGS). In the embodiment of FIG. 4 the dipole arm 432*b* is grounded by a galvanic connection to a dipole feet (not shown in FIG. 4). It should be noted that due to the view of FIG. 4 only parasitic arm 422*b* is shown, wherein parasitic arm 422*a* is provided on the opposite side on the bottom surface of the substrate of the support structure 420. The parasitic arm 422*b* is floating, that means the parasitic arm 422*b* is not galvanically connected to ground or any other conductive part of the antenna element.

It should be noted that all structures described above are the same for the opposite side of the support structure for the other dipole arm of the dipole, since the enlarged view of FIG. 4 shows just one of four sectors. Further, in FIG. 4 a further dipole with a different polarization and corresponding filtering units and parasitic arms is provided, which can be the same as the ones described above for the dipole.

Furthermore, optionally an electronically closed ring 450 is provided on the top surface of the support structure 20, which is surrounding the whole radiating structure of FIG. 4 and is galvanically isolated from the radiating structure and all other conductive parts.

Figure 5:
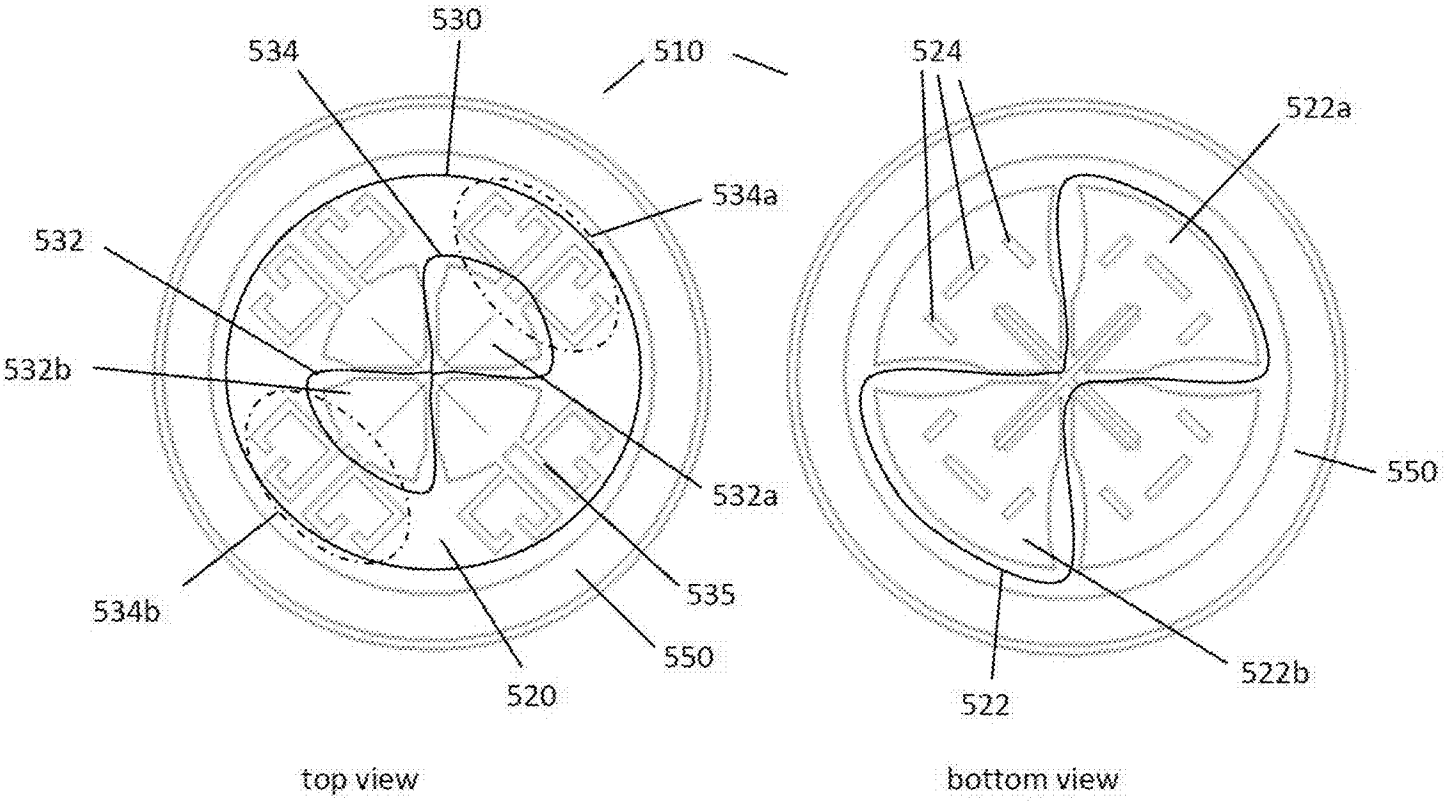
FIG. 5 shows on the left side a top view of an antenna element according to a further embodiment of the present disclosure and on the right side a bottom view of the same antenna element.

FIG. 5 shows on the left side a top view of a further embodiment of an antenna element 510 according to the present disclosure with two dipoles, each dipole 532 comprising dipole arms 532*a* and 532*b* and each dipole arm 532*a* and 532*b* is connected with a corresponding filtering unit 534*a*, 534*b* constituting a filter 534, wherein each filtering unit 534*a*, 534*b* comprises transmission lines 535. The whole arrangement of the dipole arms 532*a*, 532*b* together with filtering units 534*a*, 534*b* is provided on a top surface of the support structure 520. Furthermore, again, an electrically closed ring 550 can surround the radiating structure 530. As one can see, the transmission lines 535, which are in the embodiment of FIG. 5 stubs, intersect with the corresponding non-conductive interruptions, being slots, 524 provided on a bottom surface in the stacking direction. Furthermore, each dipole arm 532*a*, 532*b* is grounded. Furthermore, a conductive layer 522 is provided on the bottom surface of support structure 520, and each of parasitic arms 522*a*, 522*b* is floating, i.e. not galvanically connected to any other electric elements, which can also be seen in the bottom view on the right side of FIG. 5, since a small gap is provided between the dipole feet (the crossing in the middle) and the corresponding parasitic arm 522*a* or 522*b* in the bottom view, wherein the gap is made of the non-conductive substrate of the support structure 520. The dipole arms 532*a*, 532*b* in FIG. 5 are connected to the dipole feet through corresponding openings within the support structure, so that a grounding of the dipole arms 532*a*, 532*b* can be ensured. Optionally, also on the bottom side of the support structure a further ring 550 can be provided.

Further, as in the preceding embodiments, a further dipole with corresponding filtering units and parasitic arms as described above can be provided as in FIG. 5, which is of course optional.

Figure 6A:
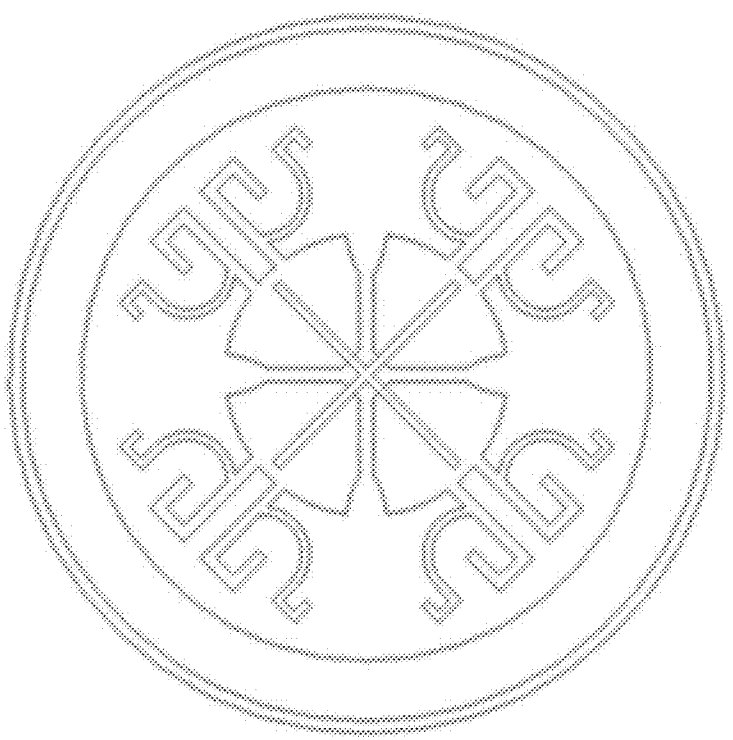
FIG. 6A shows on the left side a top view of an antenna element according to a further embodiment of the present disclosure and on the right side a bottom view of the same antenna element.
Figure 6A:
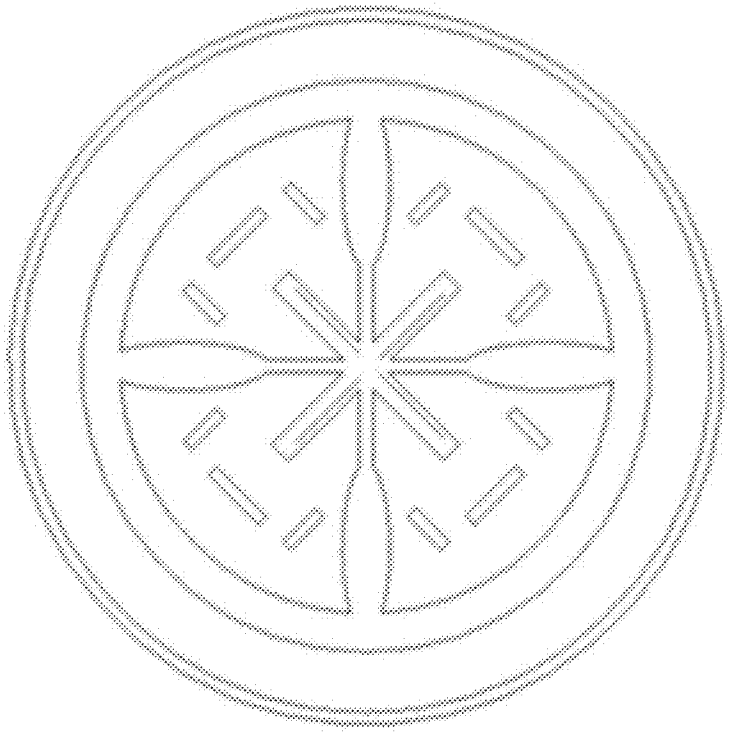

Further, FIG. 6A shows another embodiment of the antenna element according to the present disclosure, wherein on the left side a top view of the antenna element is shown in which the parasitic arms with the corresponding non-conductive interruptions are provided on the top side of the support structure and on the bottom side of the support structure the corresponding dipole arms and filtering units are provided. Therefore, in comparison to the arrangement of FIG. 5 the dipoles and the filter are provided on the bottom surface and not on the top surface. Further, the conductive layer comprising the parasitic arms is provided on the top surface. Therefore, the position of the dipole arms together with the filer is interchanged with the position of the conductive layer. It is clear that the feeding structure, which can be provided on a surface of the dipole feet should then also be adapted to this arrangement correspondingly. FIG. 6A shows an antenna element with a double DGS filter. In this context the term double DGS filter means that in one filtering unit at least two transmission lines, e.g. at least two stubs, are provided and at least two slots in the corresponding parasitic arm, and one stub "grows" from the other stub, which can be seen in FIG. 6A where one stub starts in the middle of the other stub.

Figure 6B:
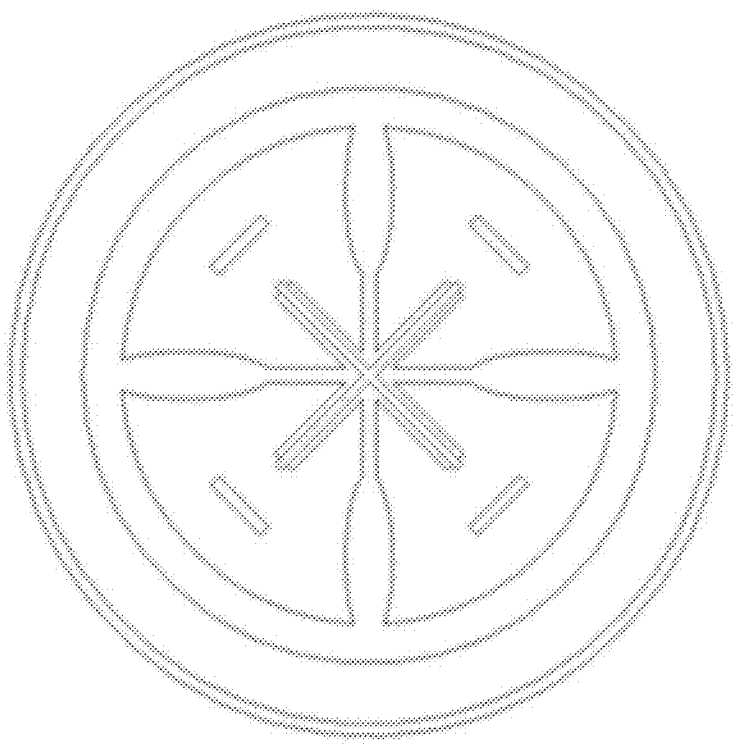
FIG. 6B shows on the left side a top view of an antenna element according to a further embodiment of the present disclosure and on the right side a bottom view of the same antenna element.
Figure 6B:
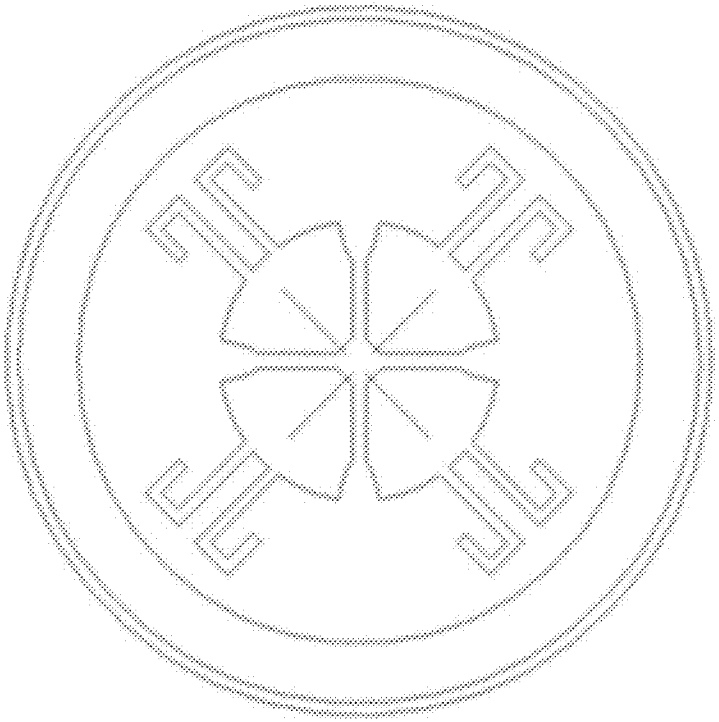

Further, FIG. 6B shows another embodiment of an antenna element according to the present disclosure, wherein the left side shows a top view comprising two dipoles and corresponding filtering units and the right side shows a bottom view showing corresponding parasitic arms and corresponding non-conductive interruptions. In this embodiment a single DGS filter is provided in which only one non-conductive interruption, e.g. slot, is provided within one corresponding parasitic arm and stubs are provided in the corresponding dipole arm, wherein no further stubs "grow" from another stub, in contrast to the embodiments of, for example, FIG. 6A in which a double DGS filter. As in all previous embodiments, in the stacking direction of the support structure the non-conductive interruptions overlap with the transmissions lines of the corresponding filtering units.

Figure 7A:
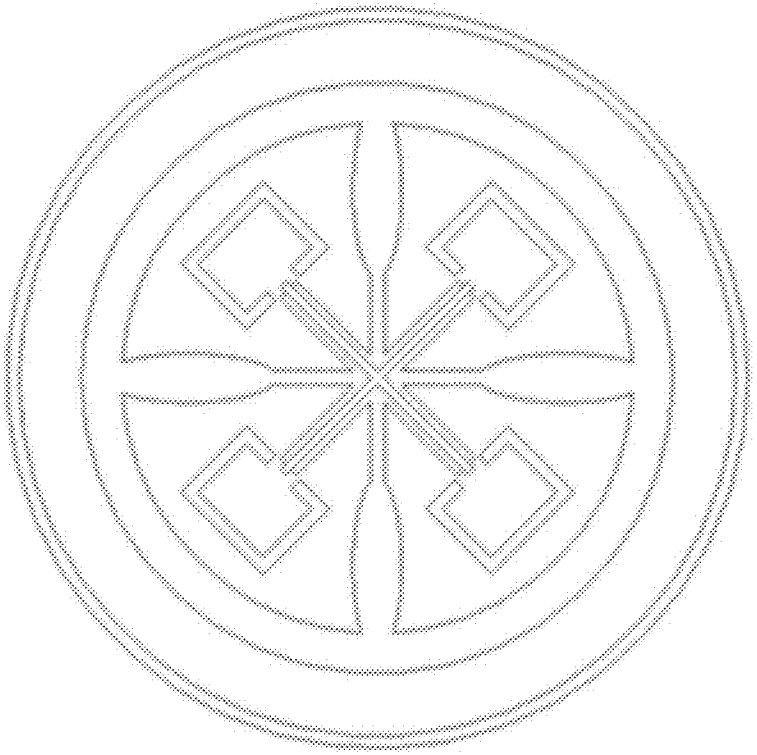
FIG. 7A shows on the left side a top view of an antenna element according to a further embodiment of the present disclosure and on the right side a bottom view of the same antenna element.

FIG. 7A shows another embodiment of an antenna element according to the present disclosure, wherein the left side shows a top view of two dipoles having transmission lines connected to the respective dipole arms. Furthermore, the right side of FIG. 7A shows a bottom view of the same antenna element with parasitic arms having complementary non-conductive interruptions, which complement the transmission lines on the top surface of the support structure.

Figure 7A:
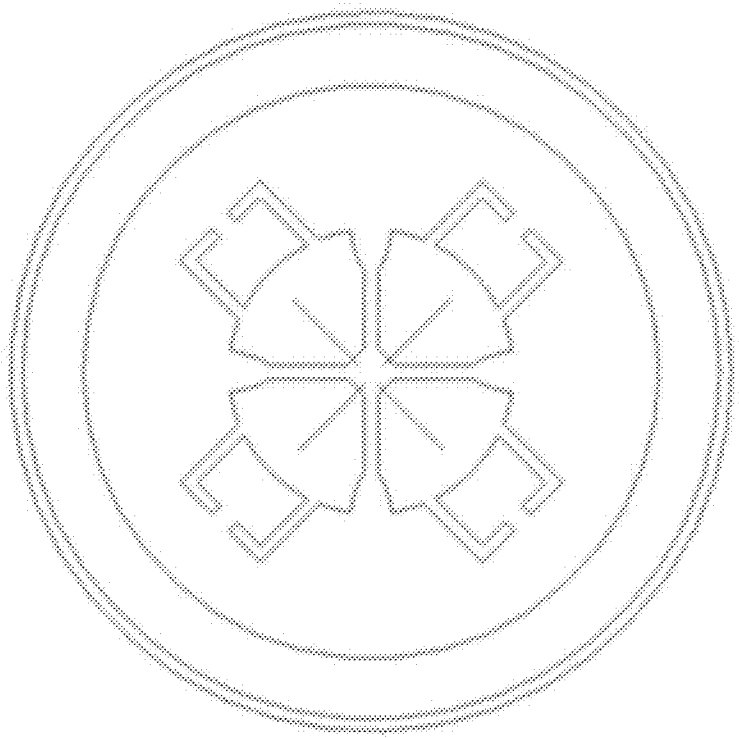
Figure 7B:
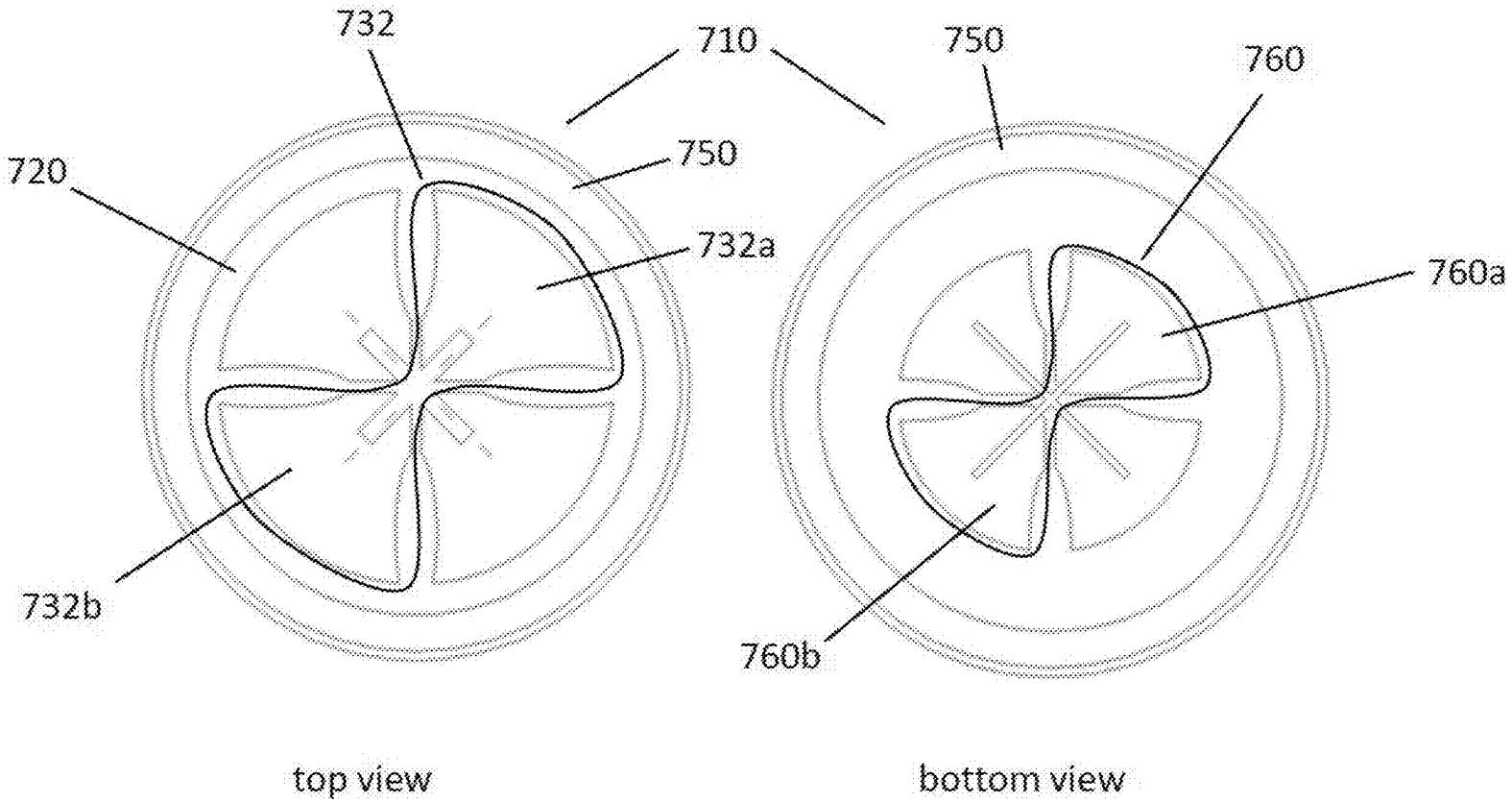
FIG. 7B shows on the left side a top view of an antenna element according to a further embodiment of the present disclosure and on the right side a bottom view of the same antenna element.

Further, FIG. 7B shows another embodiment of the present disclosure, wherein there instead of the provision of non-conductive interruptions and transmission lines, a capacitive filter is provided. Therefore, on the left side of FIG. 7, a top view of such an antenna element 710 providing a capacitive filter is shown. There, two dipoles are shown, wherein each dipole 732 comprises two dipole arms 732*a* and 732*b* provided on support structure 720. Furthermore, on the bottom side of the substrate of the support structure 720 corresponding parasitic arms 760*a* and 760*b* of a conductive layer 760 are provided. In contrast to the embodiments shown before, where the parasitic arms were left floating in the embodiment shown in FIG. 7B, both parasitic arms 760*a*, 760*b* are grounded (i.e. connected to the balun metallization). Furthermore, also both dipole arms 732*a*, 732*b* of FIG. 7B are grounded. Thereby, it is possible to provide a capacitive filtering, wherein the walls of the capacitor are formed by a dipole arm 732*a*, 732*b* and a corresponding parasitic arm 760*a*, 760*b*. Further, on the top surface and the bottom surface as shown in FIG. 7B rings 750 can be provided.

Figure 8:
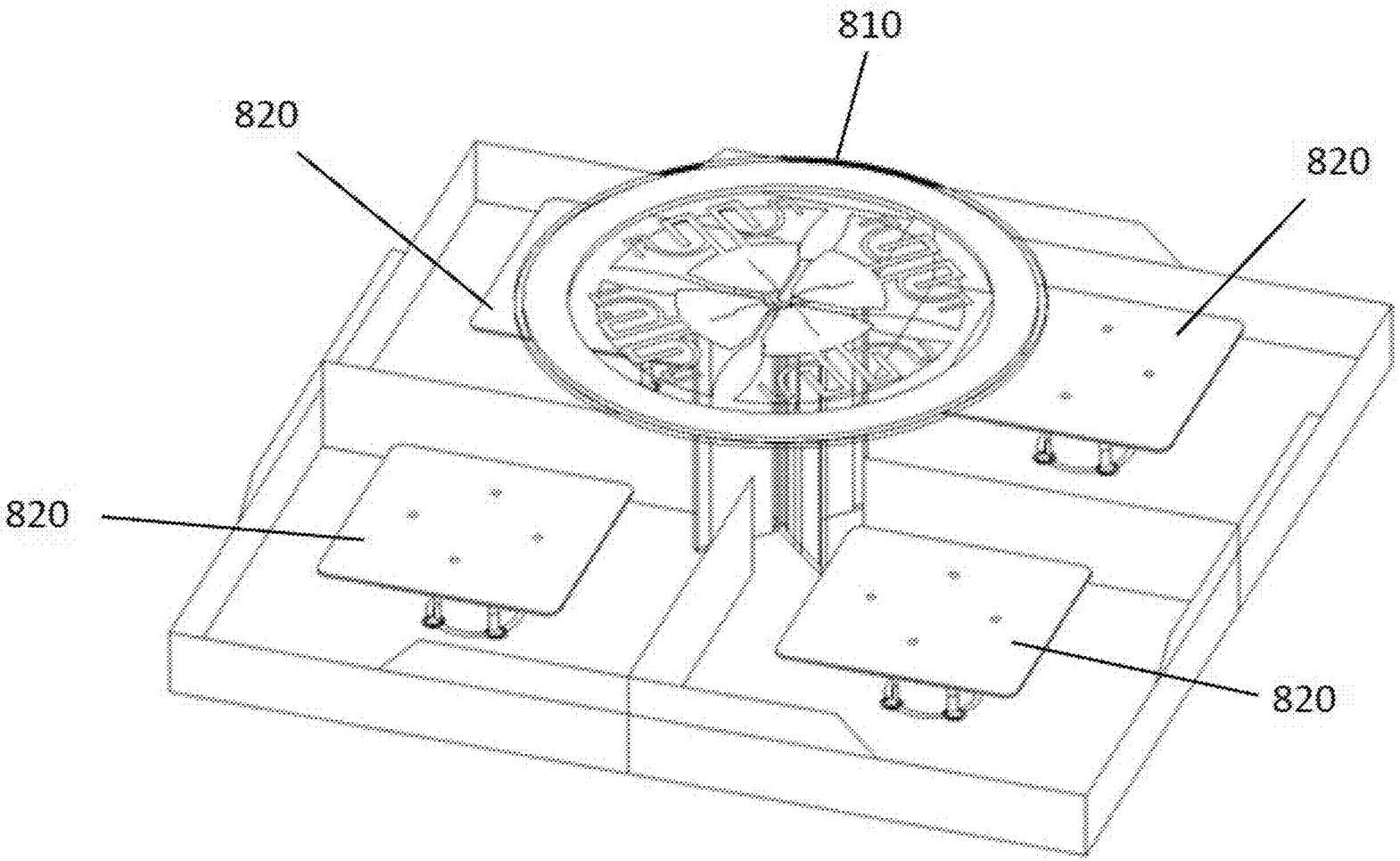
FIG. 8 shows a perspective view of an antenna system comprising a first antenna element and a second antenna element.

FIG. 8 shows a perspective view of an antenna system comprising a first antenna element 810 configured to radiate in a first operating frequency band and four second antenna element 820 configured to radiate in a second frequency band, wherein the second frequency band overlaps with harmonics of the first operating frequency band. The first antenna element 810 in the arrangement of FIG. 8 is the antenna element of FIG. 3, but could also be any other antenna element described with the embodiments before, so that a description of antenna element 810 is not again repeated here.

Furthermore, each of the second antenna elements 820 is configured to radiate in the second operating frequency, which for example is the CB band. As already described, the first antenna element 810 is configured to filter out harmonics of its own (first) operating frequency band. Assuming now that the first operating frequency band is the HB frequency band, in case that the second antenna element 820 radiates in the CB operating frequency band and the first radiating element 810 is excited by these electric field generating the CB operating frequency band of the second antenna elements 820, the filter of the antenna element 810 filters CB signals (as they are harmonics of the HB band). Hence, due to the provision of the described specific filter in the antenna element 810, which is configured to filter out the harmonics of the first operating frequency band, it is possible that almost no signals are fed back in the feeding structure of the first antenna element 810 caused by the excitation of the second radiating element 820. Therefore, a very compact arrangement as the one shown in FIG. 8 can be provided in which the first antenna element 810 is provided close to the second antenna elements 820, wherein the first antenna element 810 can also be surrounded by a plurality of second antenna elements 820 as in FIG. 8.

Figure 9:
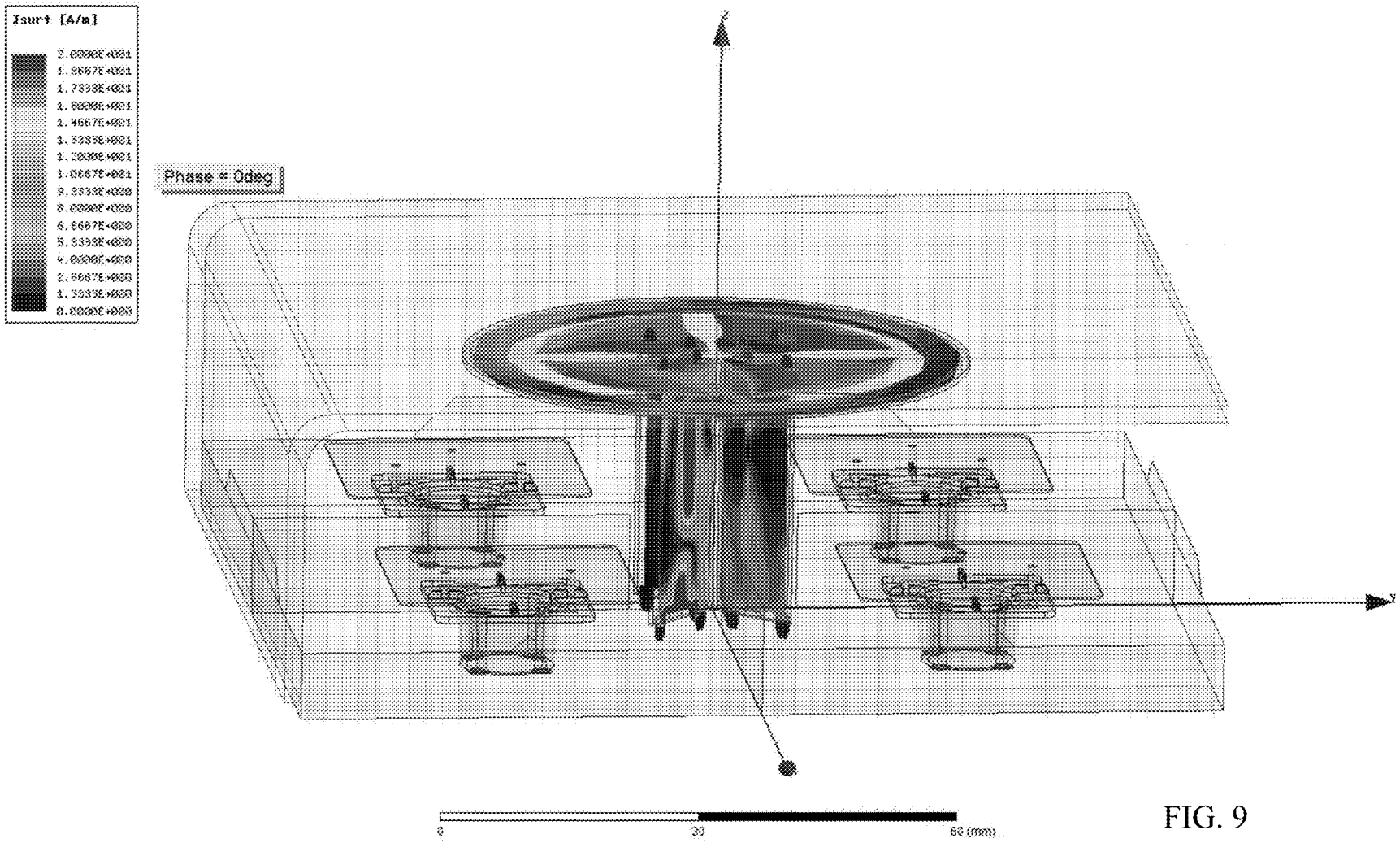
FIG. 9 shows the magnitude of surface currents in an antenna element without a filter when a further antenna element radiates in the CB operating frequency band.

Furthermore, FIG. 9 shows as an example a HB antenna element without any filters, where only antenna elements radiating in the CB operating frequency band (that means the small antenna elements surrounding the large one in FIG. 9) surround the HB antenna element. In the arrangement of FIG. 9, the HB antenna element is inactive, and only the CB antenna elements are active. In FIG. 9, one can see large surface currents excited in the feeding network arranged on the dipole feet of the HB antenna element due to the coupling of the HB antenna element to the energy distributed by the CB antenna elements.

Figure 10:
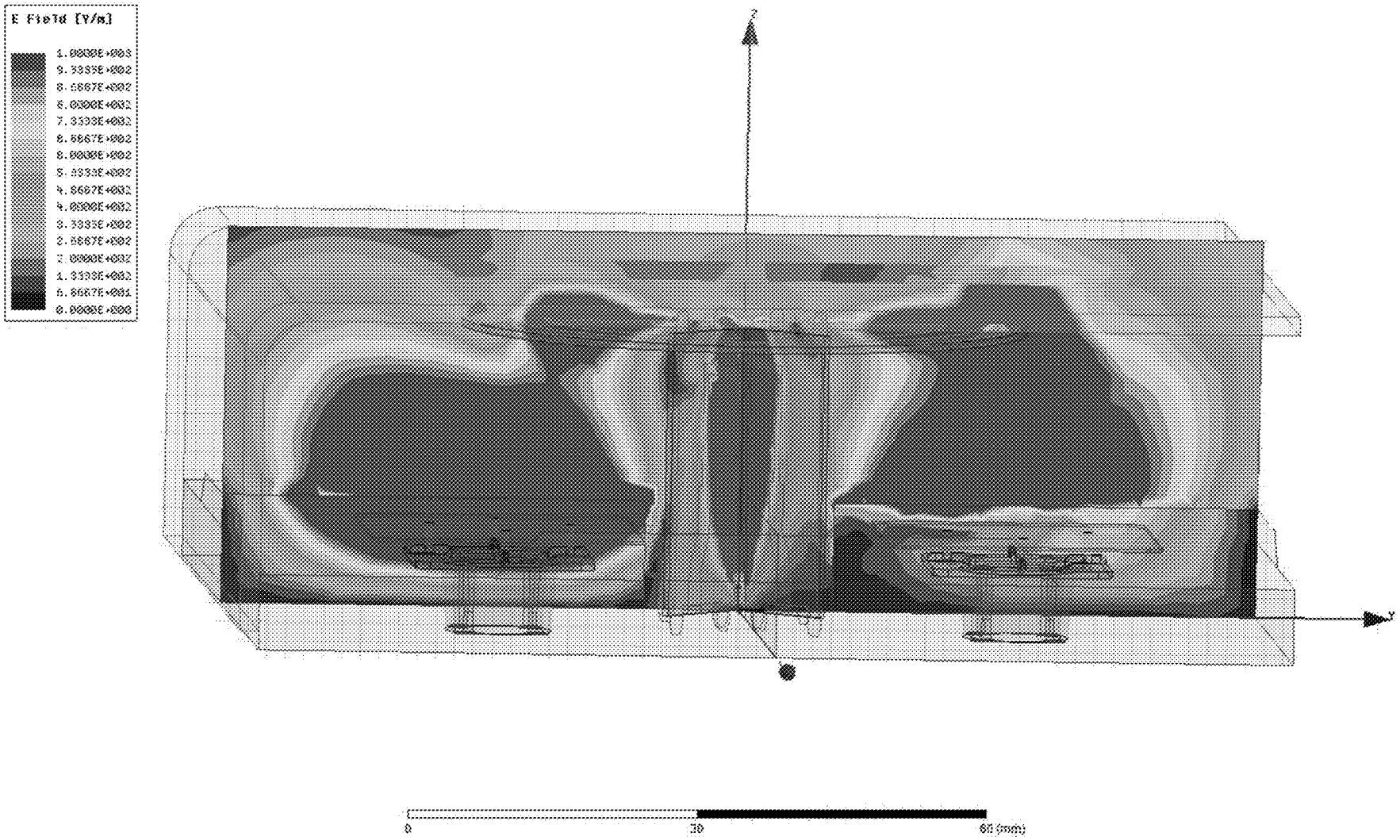
FIG. 10 shows a vertical cut of the electric field in case the antenna element is not provided with a filter and further antenna elements radiate in the CB operating frequency band.

Furthermore, FIG. 10 shows a vertical cut of the electric field in the same situation as to the one of FIG. 9. There, one can also see that the electric field generated by the CB antenna elements strongly couples to the HB antenna element and therefore the feeding structure of the HB antenna element is strongly excited.

Figure 11:
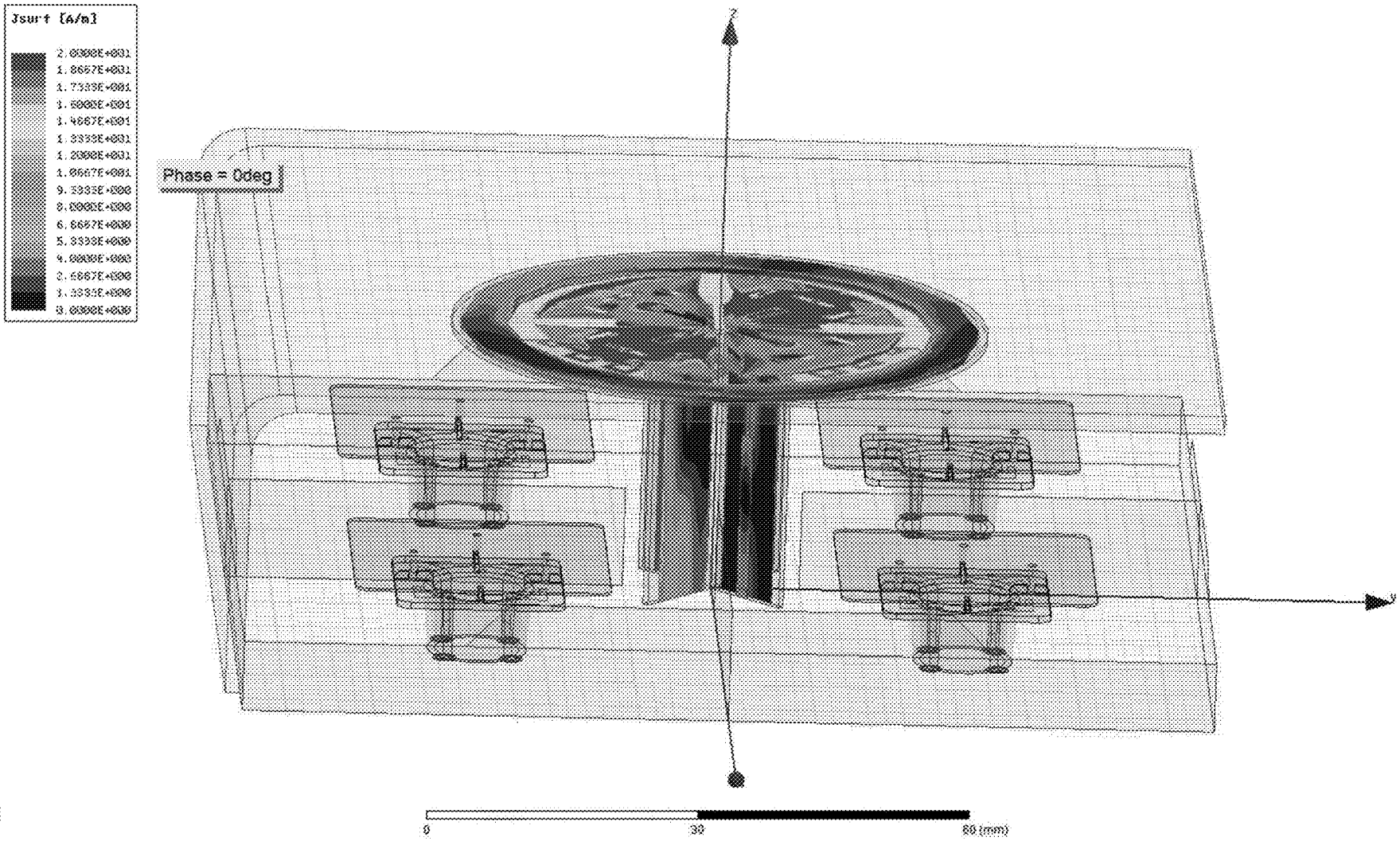
FIG. 11 shows the magnitude of surface currents in an antenna element with a filter when a further antenna element radiates in the CB operating frequency band.

Further, FIG. 11 shows an arrangement, which is similar to the arrangement of FIG. 9. However, the radiating structure of the HB antenna element has here an embedded filter connected to the radiating element as is the case with embodiments of the present disclosure. As can be seen from FIG. 11 there is a significantly less coupling of the feeding structure of the dipole feet of the HB antenna element. Therefore, the surface currents are excited in the filtering units instead of the feeding structure of the HB antenna element. Therefore, much less signals are fed back in the feeding structure of the HB antenna element.

Figure 12:
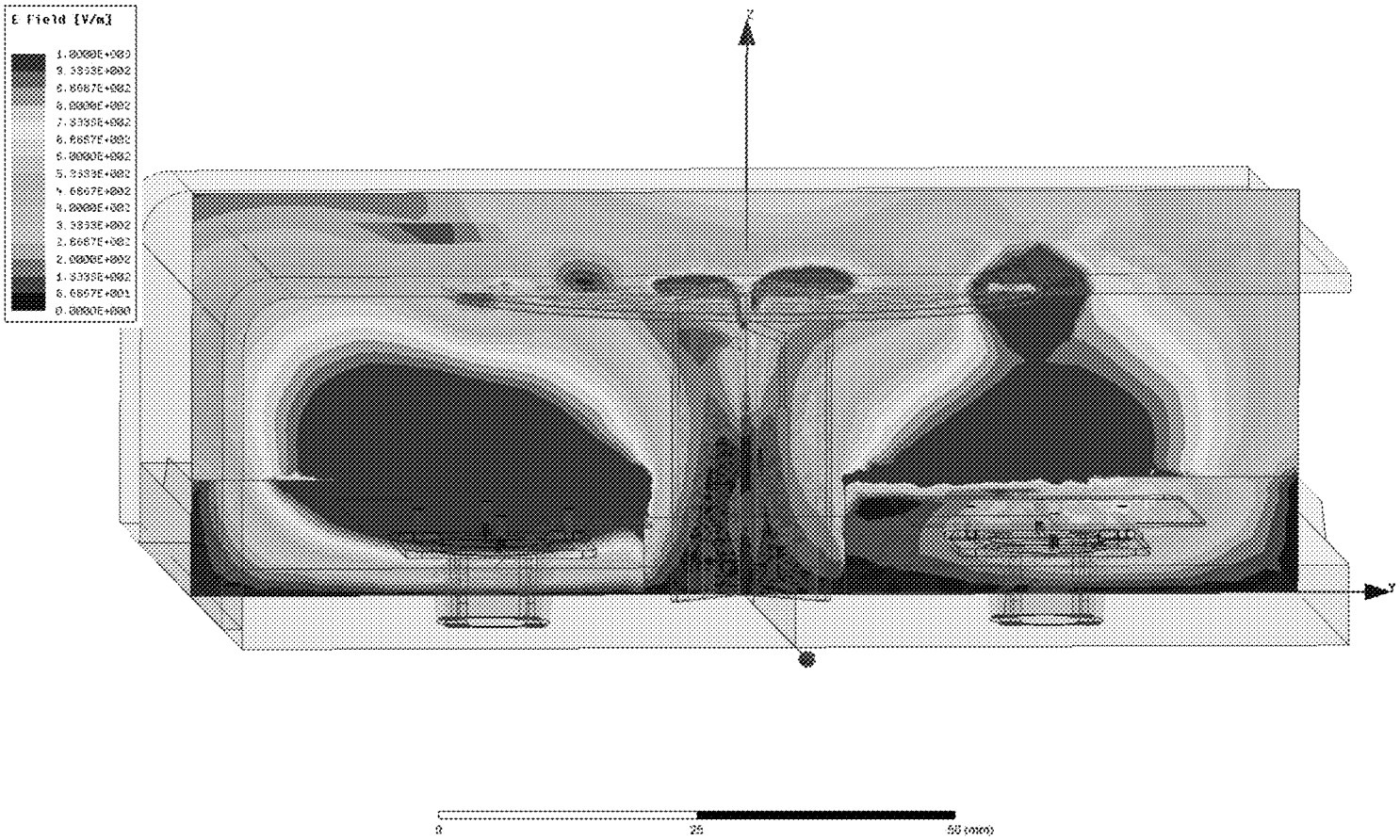
FIG. 12 shows a vertical cut of the electric field in case the antenna element is provided with a filter and further antenna elements radiate in the CB operating frequency band.

Further, FIG. 12 shows a vertical cut of the electric field of the same arrangement as the one shown in FIG. 11, wherein one can clearly see that the electric field generated by the CB antenna elements significantly less couples to the HB antenna element as compared to the situation of FIG. 10. It can be seen that the electric field now couples to the filtering units instead of the feeding structure of the HB antenna element. Further, much less coupling exists in the feeding structure of the HB radiating element compared to FIG. 10.

Although the effects achieved by the embodiments of the present disclosure are described using the HB and CB operating frequency band, it is clear that these effects can be also achieved for combination of other operating frequency bands, where closely spaced antenna elements have operating frequencies which have an harmonic relation and where at least one type of such antenna elements has a filter embedded as described in conjunction with the embodiments herein.

Furthermore, it should be perfectly clear from the overall context of the present disclosure that it is implicit that all the previous descriptions are also valid for a single polarized radiating structure, which only includes a single dipole instead of two dipoles. Furthermore, the radiating element does not have to be necessarily a dipole but a radiating element in general is also conceivable. Therefore, the dipole in the embodiments is just an example. Correspondingly, the number and dimensions of filtering units and parasitic arms are also just examples and can also be chosen differently. Furthermore, the provision of the conductive layer comprising parasitic arms and non-conductive interruptions is just optional and the disclosure can also be enabled without these features.

The foregoing descriptions are only implementation manners of the present disclosure, the scope of the present disclosure is not limited to this. Any variation or replacement can be easily made through a person skilled in the art. Therefore, the scope of protection of the present disclosure should be subject to the protection scope of the attached claims.

What is claimed is:

1. An antenna element, the antenna element comprising:
- a support structure;
- a radiating structure arranged on or within the support structure, the radiating structure comprising:
  - a radiating element having a resonant frequency inside an operating frequency band of the antenna element; and
  - a filter connected to the radiating element and configured to filter out harmonics of the operating frequency band,
- wherein the filter comprises an electrically conductive pattern comprising at least one transmission line arranged on or in the support structure.

2. The antenna element according to claim 1, further comprising a feeding structure configured to feed the radiating element, wherein the filter is arranged within the radiating structure such that the harmonics of the operating frequency band generated in the radiating element are filtered out and the harmonics are isolated from the feeding structure.

3. The antenna element according to claim 1, wherein dimensions of the at least one transmission line are configured for filtering out at least one harmonic of the operating frequency band.

4. The antenna element according to claim 1, wherein the support structure comprises a conductive layer underneath or above the transmission line, in a stacking direction of the support structure, and wherein the conductive layer comprises at least one non-conductive interruption, which is arranged to make the non-conductive interruption and the transmission line overlap in the stacking direction of the support structure.

5. The antenna element according to claim 1, wherein the support structure is a stub.

6. The antenna element according to claim 4, wherein the non-conductive interruption together with the transmission line are configured to filter out the at least one harmonic of the operating frequency band.

7. The antenna element according to claim 4, wherein the radiating element is a dipole comprising two dipole arms, the filter comprises two filtering units, and the conductive layer comprises two parasitic arms.

8. The antenna element according to claim 7, wherein in the stacking direction of the support structure, each dipole arm of the two dipole arms overlaps with a corresponding parasitic arm of the two parasitic arms.

9. The antenna element according to claim 7, wherein each dipole arm is galvanically connected with a corresponding filtering unit of the two filtering units.

10. The antenna element according to claim 7, wherein the two parasitic arms are floating and the two dipole arms are grounded.

11. The antenna element according to claim 4, wherein the non-conductive interruption is a slot.

12. The antenna element according to claim 1, further comprising at least one electrically closed ring connected to the support structure, wherein the at least one electrically closed ring surrounds the radiating structure and is galvanically isolated from the radiating structure.

13. The antenna element according to claim 1, wherein the support structure comprises a conductive layer, and the filter is formed by the conductive layer and the radiating element, and the radiating element is in a stacking direction of the support structure underneath or above the conductive layer, and the conductive layer is arranged so that the conductive layer and the radiating element overlap in the stacking direction of the support structure.

14. The antenna element according to claim 13, wherein the conductive layer comprises two parasitic arms, the radiating element is a dipole comprising two dipole arms, and the filter comprises two filtering units, wherein each filtering unit of the two filtering units is formed by one parasitic arm of the two parasitic arms and one dipole arm of the two dipole arms.

15. The antenna element according to claim 14, wherein each dipole arm of the two dipole arms and each parasitic arm of the two parasitic arms are grounded.

16. The antenna element according to claim 1, wherein the support structure is a printed circuit board (PCB) or a molded interconnect device (MID).

17. The antenna element according to claim 1, wherein the operating frequency band is between 1.7 GHz and 2.7 GHz.

18. The antenna element according to claim 1, wherein the antenna element is a base station antenna.

19. An antenna system comprising a first antenna element, configured to radiate in a first operating frequency band, and a second antenna element configured to radiate in a second operating frequency band, wherein the second operating frequency band overlaps with harmonics of the first operating frequency band; and wherein the first antenna element comprises:

a support structure;

a radiating structure arranged on or within the support structure, the radiating structure comprising:

a radiating element having a resonant frequency inside an operating frequency band of the antenna element; and a filter connected to the radiating element and configured to filter out harmonics of the operating frequency band, wherein the filter comprises an electrically conductive pattern comprising at least one transmission line arranged on or in the support structure.

* * * * *